US006048158A

United States Patent [19]

Zaniboni

[11] Patent Number: 6,048,158

[45] Date of Patent: Apr. 11, 2000

[54] DEVICE FOR WITHDRAWING AND OPENING CD CASES IN A MACHINE FOR PACKAGING COMPACT DISCS AND THE LIKE INSIDE THESE CASES

[75] Inventor: Carlo Zaniboni, Castenaso, Italy

[73] Assignee: Gima S.P.A., Zola Predosa, Italy

[21] Appl. No.: 09/072,540

[22] Filed: May 5, 1998

[51] Int. Cl.[7] ..... B65B 21/02

[52] U.S. Cl. ..... 414/411; 414/798.9; 414/737; 414/226.02; 53/492

[58] Field of Search ..... 414/411, 798.9, 414/737, 226.02; 198/468.4; 53/468, 492, 254, 382.1

[56] References Cited

U.S. PATENT DOCUMENTS

| | | | |
|---|---|---|---|
| 2,862,633 | 12/1958 | Stiles | 414/411 X |
| 3,462,917 | 8/1969 | Nakashima | 414/798.9 |
| 5,256,030 | 10/1993 | Tanaka et al. | 414/798.9 |
| 5,310,043 | 5/1994 | Alcorn | 414/798.9 X |
| 5,325,577 | 7/1994 | Bigelow et al. | 53/382.1 X |
| 5,664,405 | 9/1997 | Perego | 53/468 X |
| 5,943,845 | 8/1999 | Ilsemann | 53/468 X |

*Primary Examiner*—Frank E. Werner
*Assistant Examiner*—Steven B. McAllister
*Attorney, Agent, or Firm*—Nims, Howes, Collison Hansen & Lackert

[57] ABSTRACT

A device withdraws and opens cases for CD and the like, including a pair of shells of complementary shape, hinged along a hinge axis along one edge of the shells. A swinging arm equipped with suction cups withdraws single cases from a storage device and transfers the cases in a vertical feeding plane over a conveying line leading to a packaging section. Further suction cups, carried by a take over member, grip the case just withdrawn acting on the shells and open the case by rotation of the shells about the hinge axis. Then the take over member is moved in horizontal direction towards the conveying line to transfer the case from the opening position to a position in which the opened case is released on the conveying line for further processing.

6 Claims, 7 Drawing Sheets

DEVICE FOR WITHDRAWING AND OPENING CD CASES IN A MACHINE FOR PACKAGING COMPACT DISCS AND THE LIKE INSIDE THESE CASES

FIELD OF THE INVENTION

The present invention relates to packaging of compact discs, widely known as CDs, and similar articles into cases.

More precisely, the invention concerns a device for withdrawing cases from a storage device of the machines for packaging compact discs and the like in these cases.

DESCRIPTION OF THE PRIOR ART

Compact discs, or CDs, are usually packed inside cases formed by two shells of plastic material, usually transparent, hinged along a common edge.

A first shell is made in form of a box and forms the base for the case. An insert is placed inside the box-like shell and is provided with means for elastically locking the CD.

A second shell, of shape complementary to the shape of the box-like shell, forms a cover for the case.

In machines for packaging CDs, the above mentioned cases are withdrawn from a storage device and fed to a conveying line where means are disposed for introducing CDs therein.

Obviously, before the introduction of a CD, the two shells making up a case must be open.

In the known CD packaging machines, opening of the two shells is usually troublesome.

Moreover, opening steps need long time, which considerably influences the machines productive capacity.

SUMMARY OF THE INVENTION

The object of the present invention is to propose a device for a machine for packaging the CDs, or other similar articles, which automatically withdraws and opens each CD case, so as to simplify production cycle and reduce operative time.

The object is obtained in accordance with the contents of the claims, by means of a device for withdrawing and opening cases in a machine for packaging compact discs and the like, each of said cases being formed by two shells of complementary shape hinged together along an edge, said device including:

withdrawing means for withdrawing single cases from a storage device and for transferring each of said cases to a conveying line for supplying the cases to a packaging line, the cases being kept substantially vertical and lying in a vertical feeding plane while being transferred;

a take over member for catching each of said cases when it is taken from said withdrawing means, said take over member acting on said shells from opposite directions, when said case just withdrawn lies in said vertical feeding plane, for opening said case by rotation of said shells about said hinge axis, with said take over member being reciprocated in a direction longitudinal to said conveying line, between a case withdrawing position and a case release position in which an open case is deposited on said conveying line.

BRIEF DESCRIPTION OF THE DRAWINGS

The characteristic features of the invention will be pointed out in the following description of a preferred, but not limitative embodiment, with reference to the enclosed drawings, in which.

DESCRIPTION OF THE PREFERRED EMBODIMENT

Figure 1:
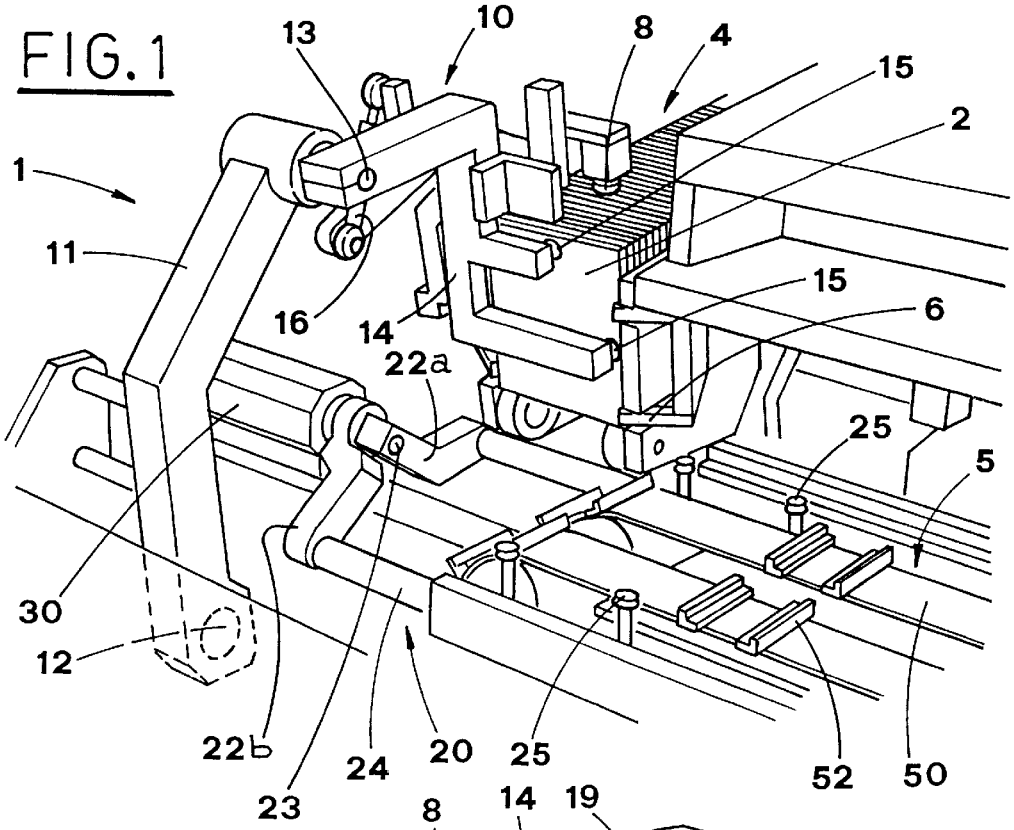
FIG. 1 is a perspective view of the device for withdrawing and opening CD cases.

With reference to the above described figures, a device for withdrawing and opening the case 2 is indicated with reference numeral 1. The device 1 is mounted on a machine for packaging CDs and the like into the cases 2.

Each case 2 is formed, in accordance to known techniques, by a pair of shells 2*a*, 2*b* having complementary shapes and hinged to each other along a common edge thus defining a hinge axis 3.

The device 1 includes a group 10 for withdrawing each time a single case 2 from a storage device 4, in which the cases 2 are arranged in a row extending crosswise to a conveying line 5 for taking the cases 2 to subsequent packaging stations.

The group 10 transfers each single case 2 to the conveying line 5, while keeping it lying in a substantially vertical feeding plane A.

The conveying line 5 includes a pair of endless conveying belts 50, arranged side by side and mounted on pulleys 51.

The conveying belts 50 feature a series of crosspieces 52, suitably spaced apart, defining corresponding seats for the cases 2 to be conveyed in open configuration to the subsequent packaging stations.

The withdrawing group 10 includes a swinging arm 11 pivoted on a pin 12 parallel to the conveying line 5. Therefore, the arm oscillates on a vertical plane crosswise to the conveying line 5.

A frame 14, extending in three orthogonal dimensions, is hinged to the top of the oscillating arm 11 so that it rotates about a hinge axis 13 parallel to the pin 12.

The frame 14 supports a series of gripping means 15, which are connected to suitable suction means.

In particular, three coplanar suction elements 15 are provided, arranged according to the corners of a triangle.

Figure 2:
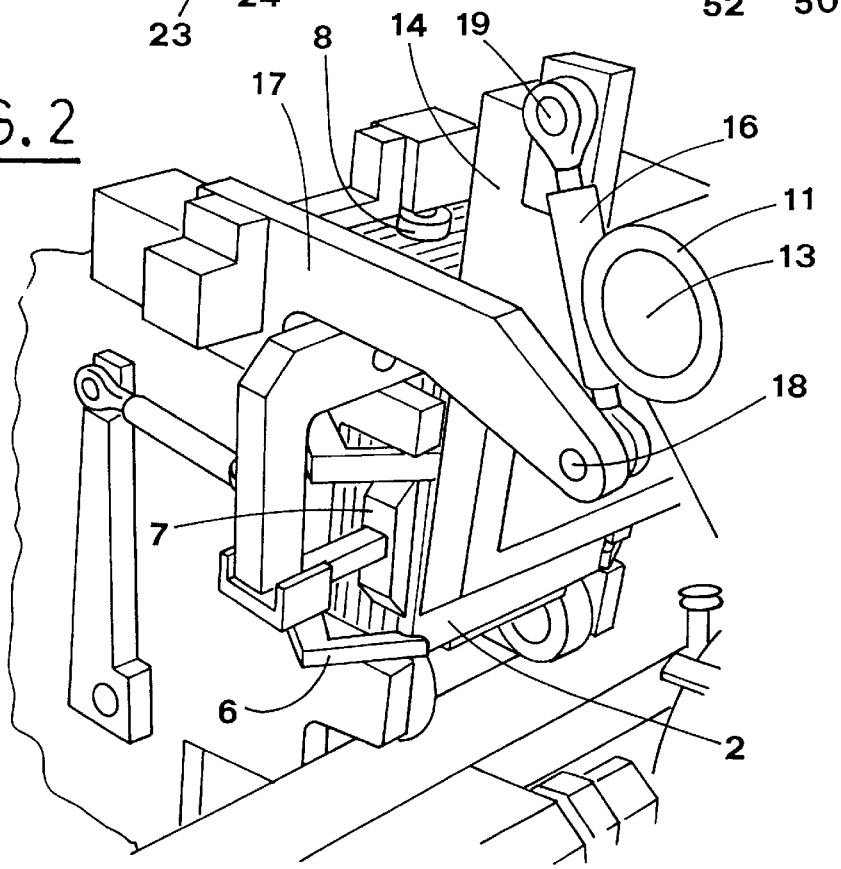
FIG. 2 is a perspective view of a part of the device of FIG. 1, seen substantially from the back with respect to the previous FIG. 1.

The frame 14 is articulated also to an auxiliary linkage formed by a connecting rod 16 lying in the same plane in which the arm 11 oscillates (see in particular FIG. 2).

One end of the connecting rod 16 is articulated to a bracket 17 protruding from a stationary frame of the machine, and the other end of the connecting rod 16 is hinged to the frame 14 through the pin 19.

The oscillation fulcrum 18 of the connecting rod 16 is therefore defined in the bracket 17, in the region of the to the articulation point between the connecting rod and the bracket.

The frame 14 is operated by the oscillating arm 11 so that it is moved between a withdrawing position, in which the suction means 15 touch the first case 2 of the row in the storage device 4, and a withdrawn position, in which this case is transferred, while being kept in vertical position always lying in the above mentioned feeding plane A.

During the transfer step, the auxiliary linkage formed by the connecting rod 16 makes the frame 14 rotate with respect to the oscillating arm 11, so as to assure that the correct orientation of the frame 14 is always maintained.

In the storage device 4, the front part of the row of cases 2 is held by two forks 6 which engage opposite sides of the first case 2 of the row.

The forks 6 can be opened by rotation about a respective vertical axis during the withdrawing of the first case 2.

During this withdrawing step, the row of subsequent cases 2 is held sidewise by a presser element 7, operated by a suitable actuator acting crosswise to the same row.

An upper presser 8 push intermittently the cases 2 arranged in row in the storage device 4, and is operated by a relative actuator, which prevent the cases 2 from deviating from the correct vertical position.

A take over member 20 cooperates with the case withdrawing group 10 when the case is located in the lower position lying in the feeding plane A. The take over member is equipped with a pair of gripping means 21*a*, 21*b*, which grip the opposite shells 2*a*, 2*b* of each case 2 withdrawn by the above mentioned withdrawing group 10.

Afterwards, the take over member 20 open the case 2 by causing rotation of the shells 2*a*, 2*b* about the hinge axis 3.

More in detail, the gripping means 21*a*, 21*b* include respective radial arms 22*a*, 22*b* carried, oscillating on a common pin 23 whose longitudinal axis is parallel and centered with respect to the conveying line 5.

Respective bars 24, equipped each with a pair of suction gripping elements 25 to be connected with suitable suction means, extend transversally from the arms 22*a*, 22*b*, parallel to the conveying line 5.

The radial arms 22*a*, 22*b* are operated by respective connecting rods 26, whose lower parts are hinged to a fork-like pusher 27, fastened to the stem 28 of a suitable vertical actuator.

The connecting rods 26 are articulated to the arms 22*a*, 22*b* by respective shafts 29, which slide through the connecting rods 26.

The radial arms 22*a*, 22*b* are carried by a carriage 30, which is mounted, on a pair of parallel guiding stems 31, which are supported by the machine stationary frame, in the region of the above mentioned feeding plane A. In this way, the carriage can slide in a direction longitudinal to the conveying line 5.

The carriage 30 carrying the take over member 20 is reciprocated on the guiding stems 31, by a crank mechanism 32 formed by a rocking lever 33, which oscillates on the feeding plane A and is articulated to the carriage 30 by a tie rod 34.

During movement of the carriage 30, the shafts 29 carrying the radial arms 22*a*, 22*b* slide with respect to the respective connecting rods 26.

The take over member 20 is reciprocated longitudinally to the conveying line 5, between a position P, in which a case 2 is withdrawn by the suction means 25, and a position R, in which the case 2 just opened is released to the conveying line 5.

The CD cases 2 are withdrawn one by one from the storage device 4, by the withdrawing group 10, which, operated by the oscillating arm 11, brings the suction means 15 to touch the first case 2 of the row stored in the storage device 4 (FIG. 1).

Figure 3A:
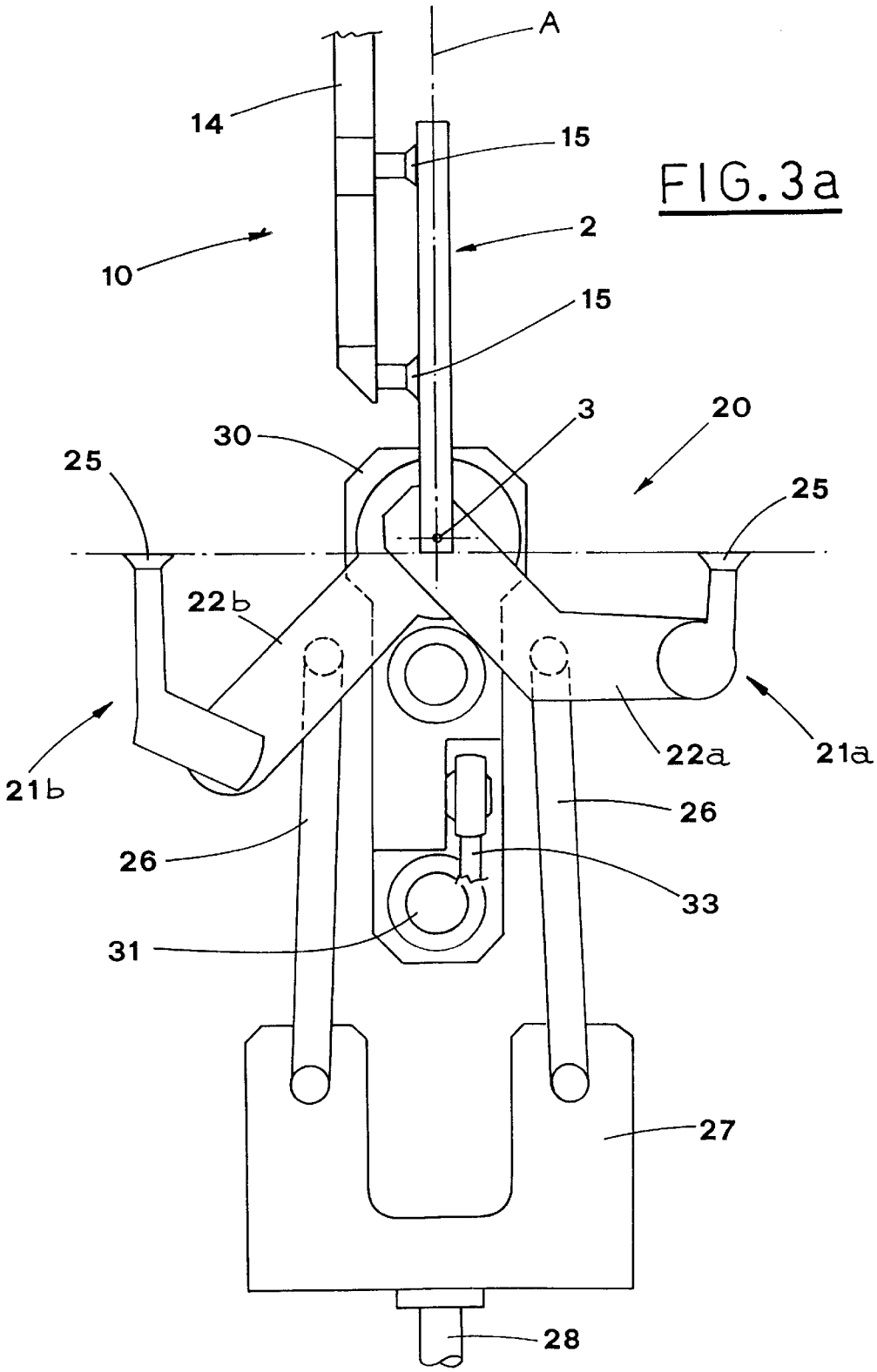
FIGS. 3*a*, 3*b*, 3*c* and 3*d* show detailed views of the device, in a cross-section with reference to a conveying line for the cases, in different operation steps.

Reverse rotation of the arm 11 brings the frame 14, supporting the suction means 15, from the withdrawing position to the backward position in which the withdrawn case 2 is conveyed while being kept vertical and lying in the feeding plane A (FIG. 3*a*).

Withdrawing of the case 2 from the storage device 4 is allowed by opening of the forks 6, simultaneously with operation of the lateral presser 7, which retains the subsequent cases 2 (FIG. 2).

After the case 2 has been withdrawn, the forks 6 are closed and the lateral presser 7 retracted, so as to allow the row of cases stored in the storage device 4 to advance.

Afterwards, the case 2 carried by the withdrawing group 10 on the feeding plane A, is caught by the take over member 20, whose gripping means 21*a*, 21*b* grip the opposite shells 2*a*, 2*b* of the case 2.

Figure 3B:
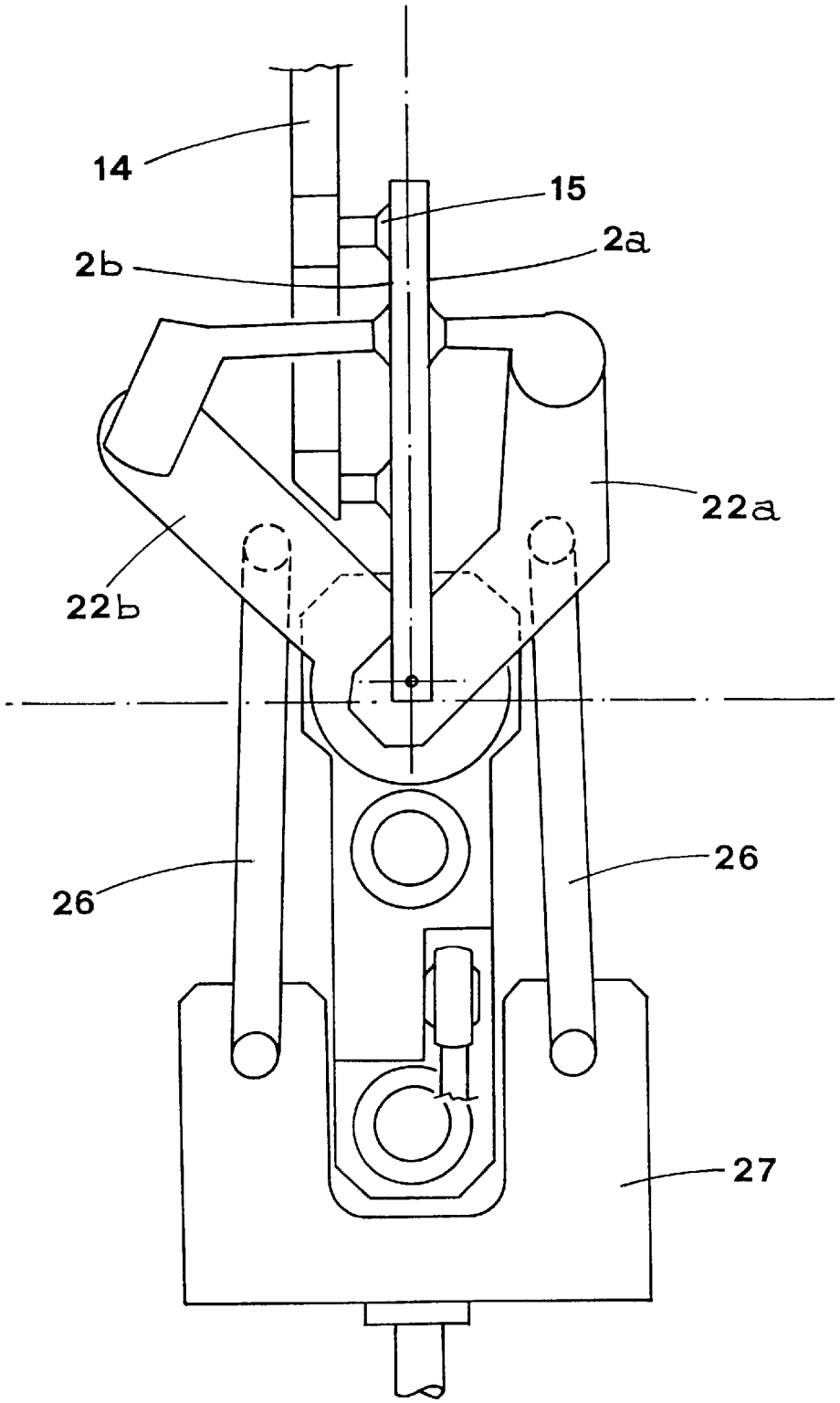

For this purpose, the radial arms 22*a*, 22*b*, equipped with suction means 25, are operated simultaneously by the relative connecting rods 26, until these suction means 25 touch the above mentioned shells 2*a*, 2*b* (FIG. 3*b*).

When the case 2 is caught by the suction means 25 of the take over member 20, the suction means 15 of the withdrawing group 10 are detached.

Figure 4:
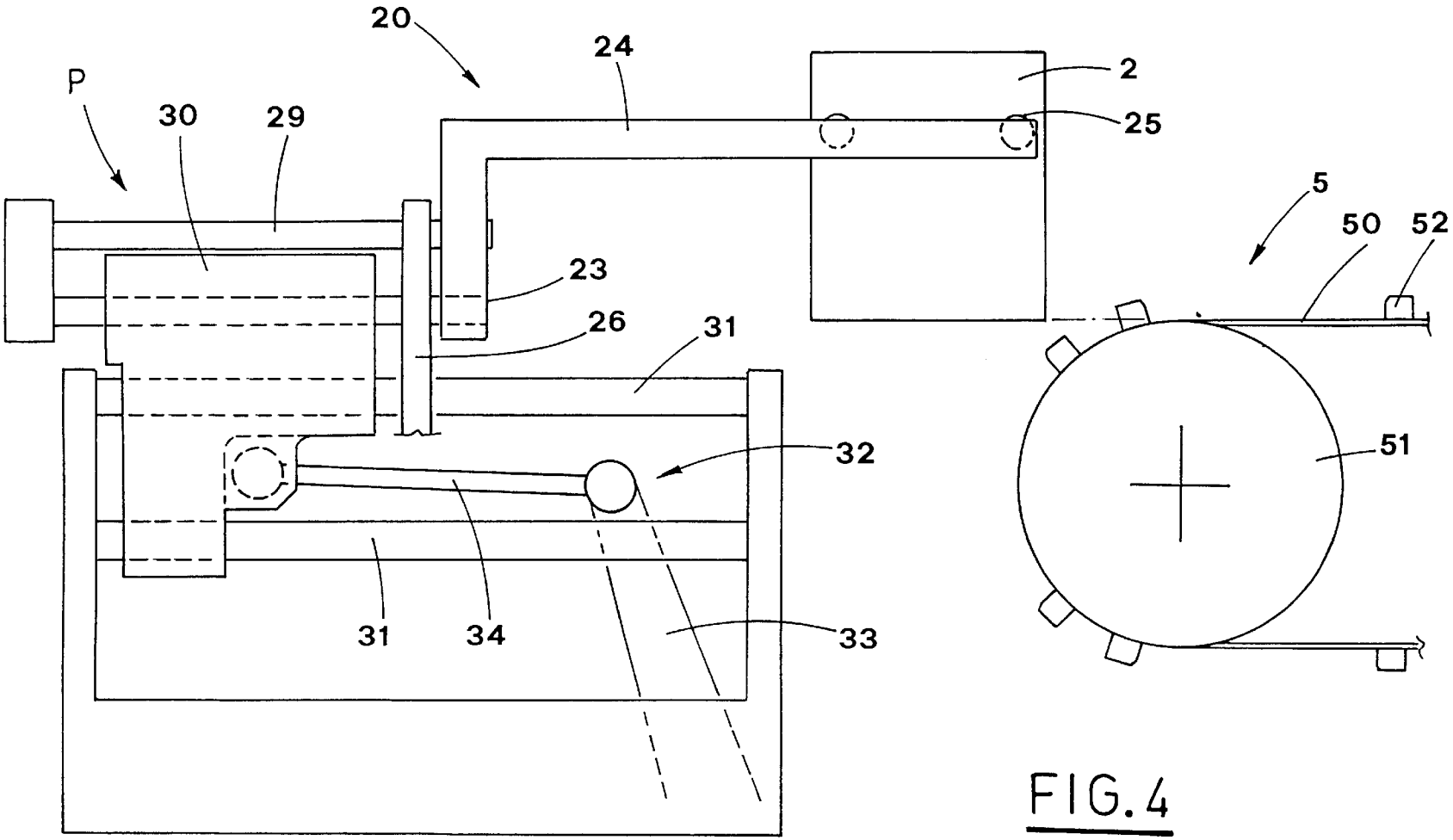
FIGS. 4 and 5 show lateral schematic views of the device, respectively in a position in which a case is withdrawn and in a position in which the case, opened, is released on the conveying line.
Figure 5:
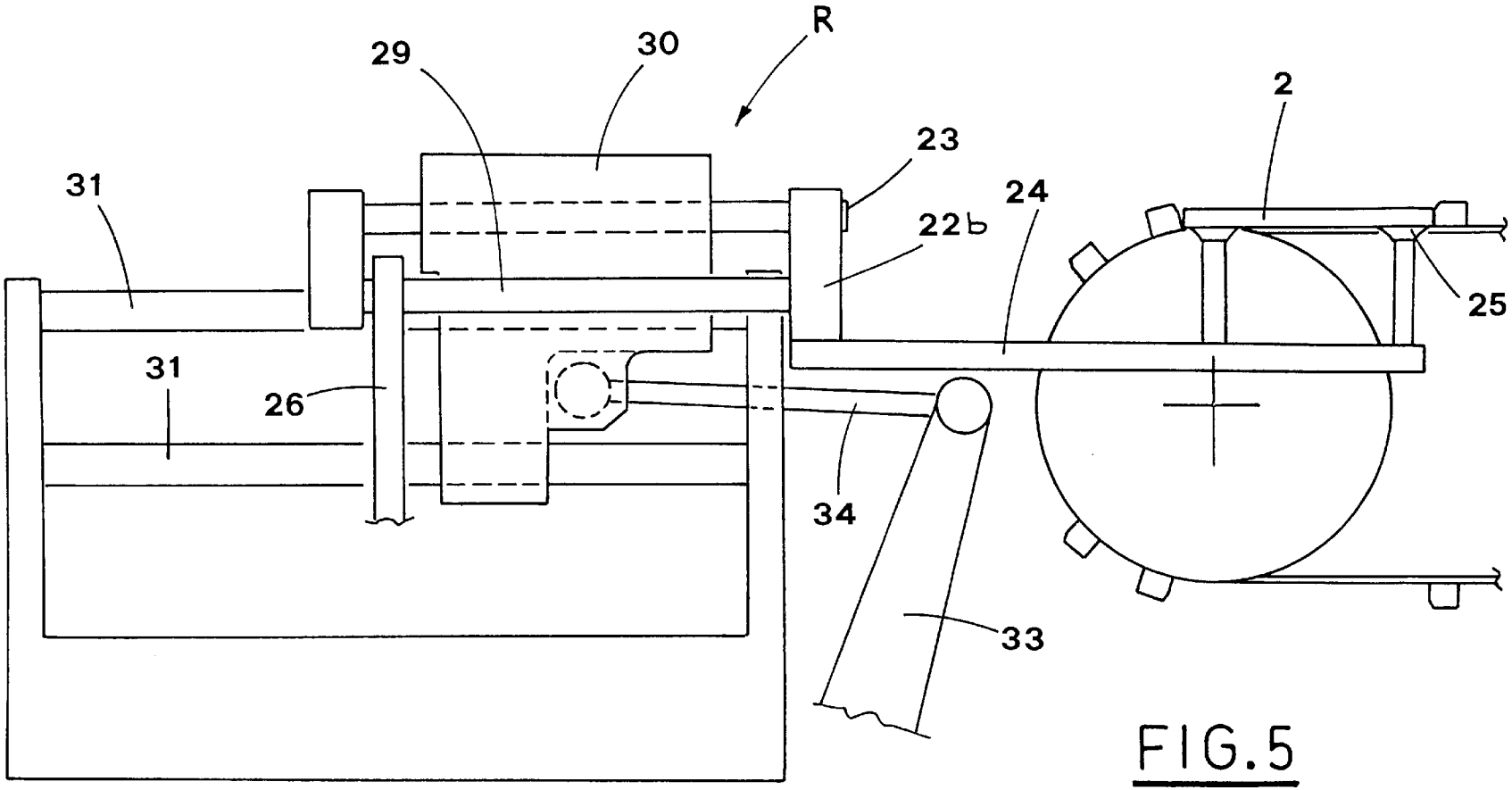

Afterwards, the crank mechanism 32 drives the carriage 30 to slide on the guiding stems 31, so as to bring the take over member 20 from the cases withdrawing position P, seen in FIG. 4, to the position R, in which the cases 2 are released to the conveying line 5, as shown in FIG. 5.

Figure 3C:
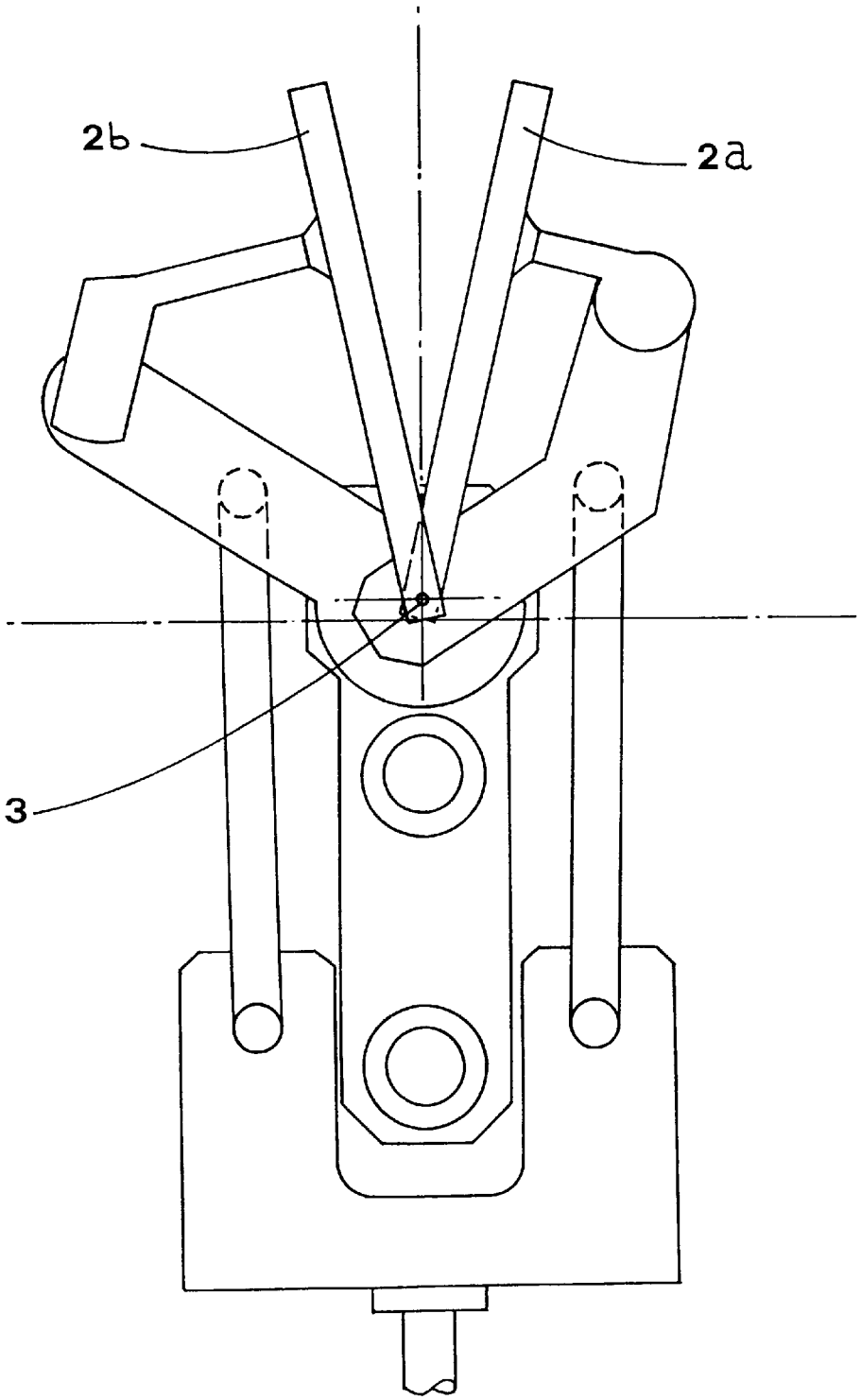

During the movement of the carriage 30, the gripping means 21*a*, 21*b* open the shells 2*a*, 2*b* of the case 2, due to rotation of the radial arms 22*a*, 22*b* operated by the relative connecting rods 26 (FIG. 3*c*).

It is to be pointed out that the shells 2*a*, 2*b* can be opened because the radial arms 22*a*, 22*b* rotation center, defined by the pin 23, is aligned with the hinge axis 3 of the shells 2*a*, 2*b* of the case 2, when the case has been brought to the feeding plane A by the withdrawing group 10 and, in this position, caught by the take over member 20.

Figure 3D:
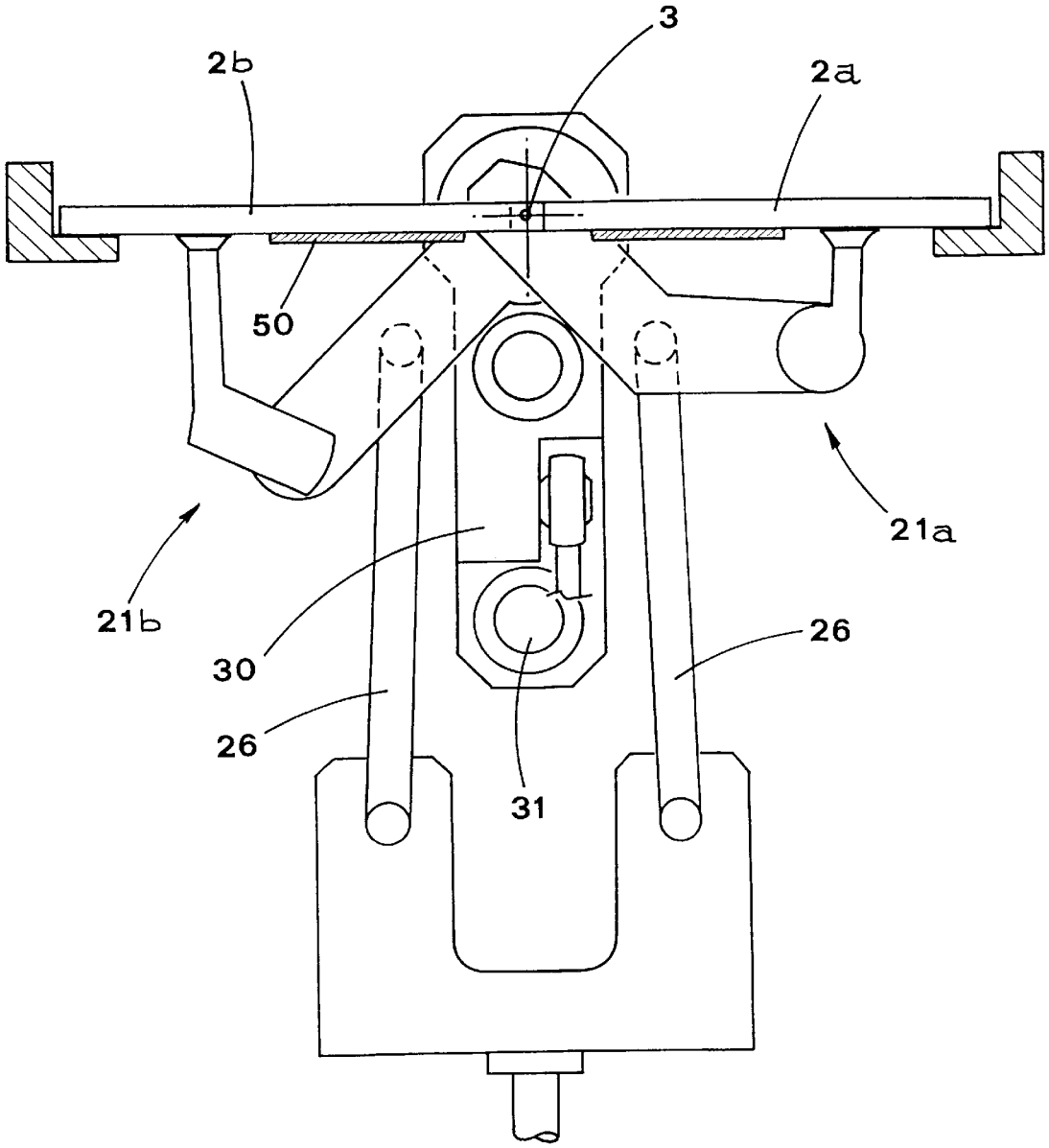

In the release position R, the gripping means 21*a*, 21*b* complete the opening of the shells 2*a*, 2*b* (FIG. 3*d*) and the case 2 is placed, with the shells 2*a*, 2*b* open, on the conveying belts 50 of the line 5, in a corresponding seat defined by the crosspieces 52 (see also FIG. 5).

The described device allows to automatically withdraw and open CD cases and the like, in machines for packaging CD, so as to simplify the production cycle and reduce operative time.

In fact, the cases are opened during their transport from the storage device in which they are kept to the conveying line which feeds the machine packaging means.

Moreover, this opening is performed in a particularly simple way.

It is understood that what above has been described as a mere, non limitative example, therefore possible constructive variants remain within the protective scope of the present technical solution, as described above and claimed in the following.

What is claimed is:

1. A device for withdrawing and opening cases in a machine for packaging compact discs and the like, each of said cases being formed by two shells of complementary shape hinged together along an edge to define a hinge axis, said device including:

withdrawing means for withdrawing cases one by one from a storage device and for transferring each of said cases to a conveying line for supplying the cases to a packaging line, the cases being kept substantially vertical and lying in a vertical feeding plane while being transferred;

a take over member for catching each of said cases when it is held by said withdrawing means, said take over member acting on said shells from opposite directions, when said case just withdrawn lies in said vertical feeding plane, for opening said case by rotation of said shells about said hinge axis, with said take over member being reciprocated in a direction longitudinal to said conveying line, between a case withdrawing position and a case release position in which an open case is deposited on said conveying line.

2. A device, according to claim 1, wherein said withdrawing means include an oscillating arm, swinging on a vertical plane crosswise to said conveying line and having a free end carrying a frame articulated thereto and pivoting on a hinge axis parallel to a pivot axis of the oscillating arm, said frame supporting a series of gripping means, with a connecting rod hinged to said frame and to a stationary point of said machine so as to provoke a relative rotation of said frame with respect to said swinging arm, with said frame being moved by said oscillating arm between the withdrawing position, in which said withdrawing means touch a first case of the row of cases in the storage device, and a backward position, in which said case is transferred, while being kept in a vertical position and lying in said vertical feeding plane.

3. A device, according to claim 1, wherein said take over member includes a pair of gripping means aimed at acting on said shells when the case lies in said vertical feeding plane, and includes a pair of radial arms carried oscillating on a common pin parallel and centered with respect to said conveying line, said radial arms being equipped with suction means arranged longitudinally to said conveying line.

4. A device, according to claim 3, wherein said radial arms are operated by respective connecting rods, whose lower parts are hinged to a pusher connected to a vertical actuator, with said connecting rods articulated to said arms by respective shafts which slide through these connecting rods.

5. A device, according to claim 3, wherein a pivot center of said radial arms defined by said pin is aligned with the hinge axis of said shells of the case lying in the vertical feeding plane.

6. A device, according to claim 1, wherein said take over member is carried by a carriage which is slidingly mounted on guiding stems parallel to said conveying line, said carriage being reciprocated by a crank mechanism between said case withdrawing position and said case release position.

* * * * *